US005293664A

United States Patent [19]

Lim et al.

[11] Patent Number: 5,293,664

[45] Date of Patent: Mar. 15, 1994

[54] LOW NOISE AND LESS VIBRATION VACUUM CLEANER

[75] Inventors: Moo S. Lim, Seoul; Chang W. Son; Sang B. Kang, both of Incheon, all of Rep. of Korea

[73] Assignee: Daewoo Electronics Co., Ltd., Seoul, Rep. of Korea

[21] Appl. No.: 815,764

[22] Filed: Jan. 2, 1992

[30] Foreign Application Priority Data

Jul. 26, 1991 [KR] Rep. of Korea ..... 91-12898

[51] Int. Cl.[5] ..... A47L 9/22

[52] U.S. Cl. ..... 15/326; 15/327.7; 15/412; 55/276

[58] Field of Search ..... 15/326, 412, 327.7; 55/276; 181/231, 269; 417/312

[56] References Cited

U.S. PATENT DOCUMENTS

| | | | |
|---|---|---|---|
| 2,107,819 | 2/1938 | Faber | 417/312 |
| 2,888,093 | 5/1959 | Wahlborg et al. | 55/276 |
| 3,466,696 | 9/1969 | Grellsson | 15/327.7 |
| 4,533,370 | 8/1985 | Ikezaki et al. | 15/326 X |
| 4,864,683 | 9/1989 | Herron, Jr. et al. | 15/326 X |

FOREIGN PATENT DOCUMENTS

| | | | |
|---|---|---|---|
| 0235638 | 9/1987 | European Pat. Off. | 15/412 |
| 52-35474 | 3/1977 | Japan | 15/326 |
| 53-38164 | 4/1978 | Japan | 15/326 |
| 63-25775 | 5/1988 | Japan . | |

*Primary Examiner*—Stephen F. Gerrity

*Attorney, Agent, or Firm*—Merchant, Gould, Smith, Edell, Welter & Schmidt

[57] ABSTRACT

A vacuum cleaner with noise and vibration greatly reduced is disclosed. The vacuum cleaner includes a blower assembly which comprises a vibration absorbing assembly for absorbing vibrations occurring due to high speed revolutions of electric blower, a noise shielding assembly for shielding the noise so as to prevent the noise from being propagated from the electric blower to outside of the vacuum cleaner, a flow path changing assembly for curving and extending a flow path by bending the flow path of air after passing through the electric blower, and a noise absorbing assembly suppressing the noise by absorbing the noise propagated through the flow path. The vacuum cleaner further includes a blower assembly receiving section, which shields and absorbs the noise. Further, a vibration absorbing assembly is disposed on a contact portion between a vacuum cleaner main body and the blower assembly, and an air suction hole is formed on a partition wall which separates the dust collecting room and the blower receiving room from each other, so that the noise generated by the electric blower should be shielded without giving any increased resistance to the flow path of air.

12 Claims, 11 Drawing Sheets

LOW NOISE AND LESS VIBRATION VACUUM CLEANER

FIELD OF THE INVENTION

The present invention relates to a vacuum cleaner capable of cleaning floors of homes and offices by sucking up dust, tiny sand particles and other dirty materials lying around or adhering to the floors through an action of vacuum sucking power, and particularly to a low noise vacuum cleaner in which noise is reduced.

BACKGROUND OF THE INVENTION

Generally, while vacuum cleaners provide convenience in their use, they produce a lot of noise, and therefore, there is the problem that an interior of a room becomes very noisy during their use.

The reason why the conventional vacuum cleaners are very noisy is that they are not equipped with effective noise shielding means, noise absorbing means and vibration absorbing means, as shown in a structure of FIG. 9.

In a conventional vacuum cleaner, which is illustrated in FIG. 9, the noise from an electric blower 1, which is the noise generating source is shielded only once, and most of the noise is propagated to outside by passing through a body of the vacuum cleaner.

Further, the noise is transmitted through an outlet section 32 to the outside without being hindered by anything at all, and further, the noise is also transmitted to the outside by passing through an air suction hole 37 which is formed on a partition wall 36 which isolates a dust collecting room X and a blower receiving room Y from each other.

Further, vibrations are generated upon activating the electric blower, but there is nothing provided to absorb these vibrations.

The usual conventional vacuum cleaners as described above are very inconvenient because of the severeness of the noise they produce, and therefore, users are waiting for a vacuum cleaner which produces little or no noise.

Japanese Patent Publication No. Sho-63-25775 which was published on May 26, 1988 after being filed by Sharp Corporation of Japan on Apr. 8, 1982 is constituted such that the discharge path of filtered air is curvedly formed, and that noise shielding means and noise absorbing means are provided.

In the vacuum cleaner of the prior art as mentioned above, discharge path is curved in such a way that filtered air which is discharged backwardly from a rear portion of the electric blower is allowed to collide with the body of the vacuum cleaner, and then, is allowed to turn toward a front. However, the technology that the filtered air passing through the discharge path is protected from being subject to resistance has not been developed. Further, the noise shielding means and the noise absorbing means are installed only around the electric blower.

Thus the improved vacuum cleaner of the prior art is capable of reducing the noise to a certain degree, but not to the extent that users are satisfied.

Vacuum cleaners have to have strong suction power in order to suck up dust and dirt, and therefore, it is generally recognized that a noisy vacuum cleaner has to be accepted, with further reduction of noise being impossible.

OBJECTIVE OF THE INVENTION

The present invention is intended to expel an accustomed conception that noise removal in a vacuum cleaner is impossible, and to overcome the above described disadvantages of the conventional techniques by providing a low noise vacuum cleaner.

Therefore, it is an objective of the present invention to provide a vacuum cleaner in which noises are greatly reduced by providing noise shielding means, noise absorbing means and a curved discharge path, without adversely affecting the performance of the vacuum cleaner.

It is another objective of the present invention to provide a vacuum cleaner in which noises are greatly inhibited by providing vibration absorbing means.

SUMMARY OF THE INVENTION

In achieving the above objectives, the vacuum cleaner according to the present invention includes a blower assembly which comprises: vibration absorbing means for absorbing vibrations of the electric blower during high revolutions; noise shielding means for shielding noise from electric blower so that the noise will not be propagated to outside; flow path changing means for curving and extending flow path of filtered air (flowing from the electric blower to the outside); and noise absorbing means for suppressing the noise by absorbing them passing through the flow path.

The vacuum cleaner, according to the present invention, further includes: a blower assembly receiving section for supporting the blower assembly within a blower receiving room of a vacuum cleaner main body, and for finally absorbing or shielding the noise generated from the blower assembly; and the vibration absorbing means disposed on a portion where the vacuum cleaner main body and the blower assembly are contacted to each other. Further, an air suction hole is formed on a partition wall separating the dust collecting room and the blower receiving room from each other, so that the noise generated from the electric blower should be shielded without giving an adverse influence to a flow of air.

BRIEF DESCRIPTION OF THE DRAWINGS

The above objectives and other advantages of the present invention will become more apparent by describing in detail the preferred embodiment of the present invention with reference to the attached drawings in which.

DETAILED DESCRIPTION OF THE PREFERRED EMBODIMENT

Figure 1:
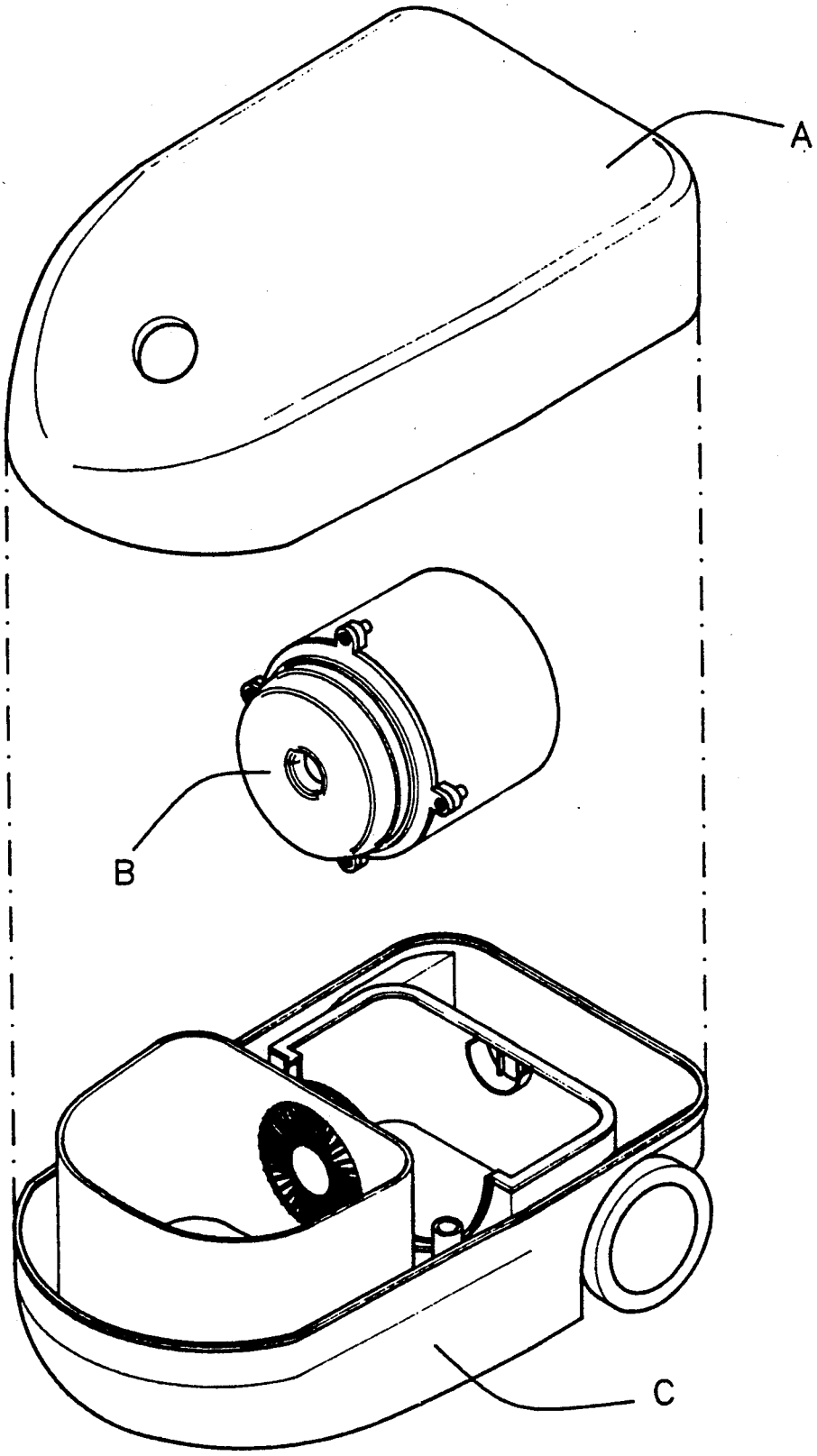
FIG. 1 is an exploded perspective view of the vacuum cleaner according to the present invention.
Figure 2:
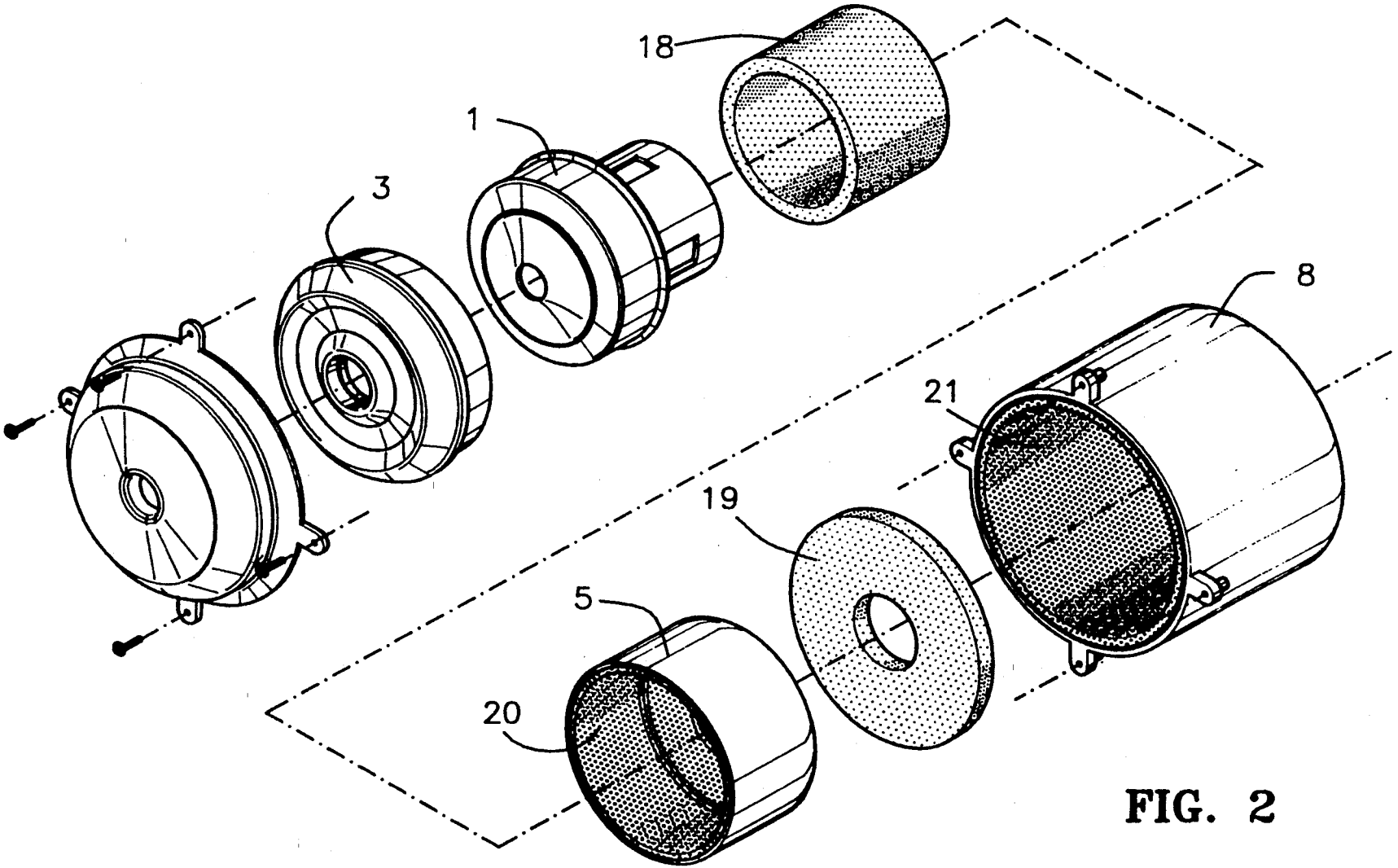
FIG. 2 is an exploded perspective view of the blower assembly installed within the vacuum cleaner according to the present invention.

As shown in FIG. 1, a low noise vacuum cleaner according to the present invention includes an upper main body assembly A, a blower assembly B and a lower main body assembly C.

Of the components of the vacuum cleaner, first the blower assembly will be described referring to FIGS. 2 to 5. The blower assembly B includes: vibration absorbing means for absorbing the vibrations generated due to the high speed revolution of an electric blower 1; noise shielding means acting as a shield so that noise will not be propagated from the electric blower 1 to the outside; flow path changing means for curving and extending the flow path of the filtered air (flowing from the electric blower 1 to the outside); and noise absorbing means for suppressing the noises by absorbing them during their propagation through the flow path.

The blower assembly B includes: a blower frontal shock absorbing member 3 provided on the frontal face of the electric blower 1, surrounding the frontal face and a part of the side face of the electric blower 1, and provided with a suction hole 2 on the frontal face thereof; and a rear blower shock absorbing member 4 provided on a projected portion formed at the center of the rear face of the electric blower 1, as a vibration absorbing means for absorbing the vibrations of electric blower 1.

The blower assembly B further includes cylindrical intermediate case 5 and a blower case 8 as a noise shielding means for shielding the noises so that the noises will not be propagated to the outside. The cylindrical intermediate case 5 is installed around a motor section of electric blower 1. In the case 5, its frontal face is open, and its rear wall is supported upon rear blower shock absorbing member 4. The blower case 8 surrounds the blower assembly, and is provided with a suction hole 6 at the center of the frontal wall thereof, and a plurality of outlet holes 7 on the rear wall in an annular form.

Figure 4:
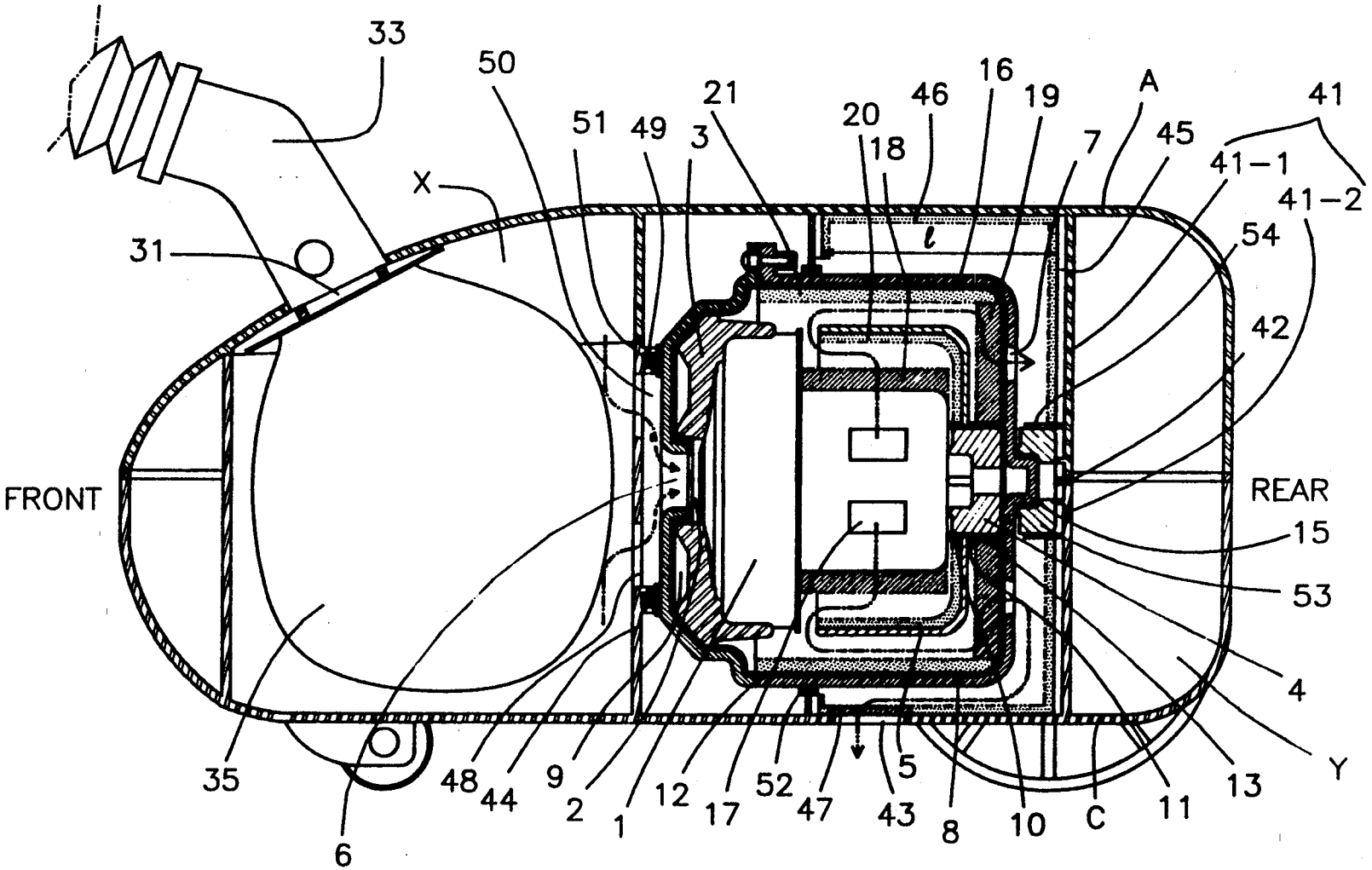
FIG. 4 is a side sectional view of the vacuum cleaner according to the present invention.
Figure 5:
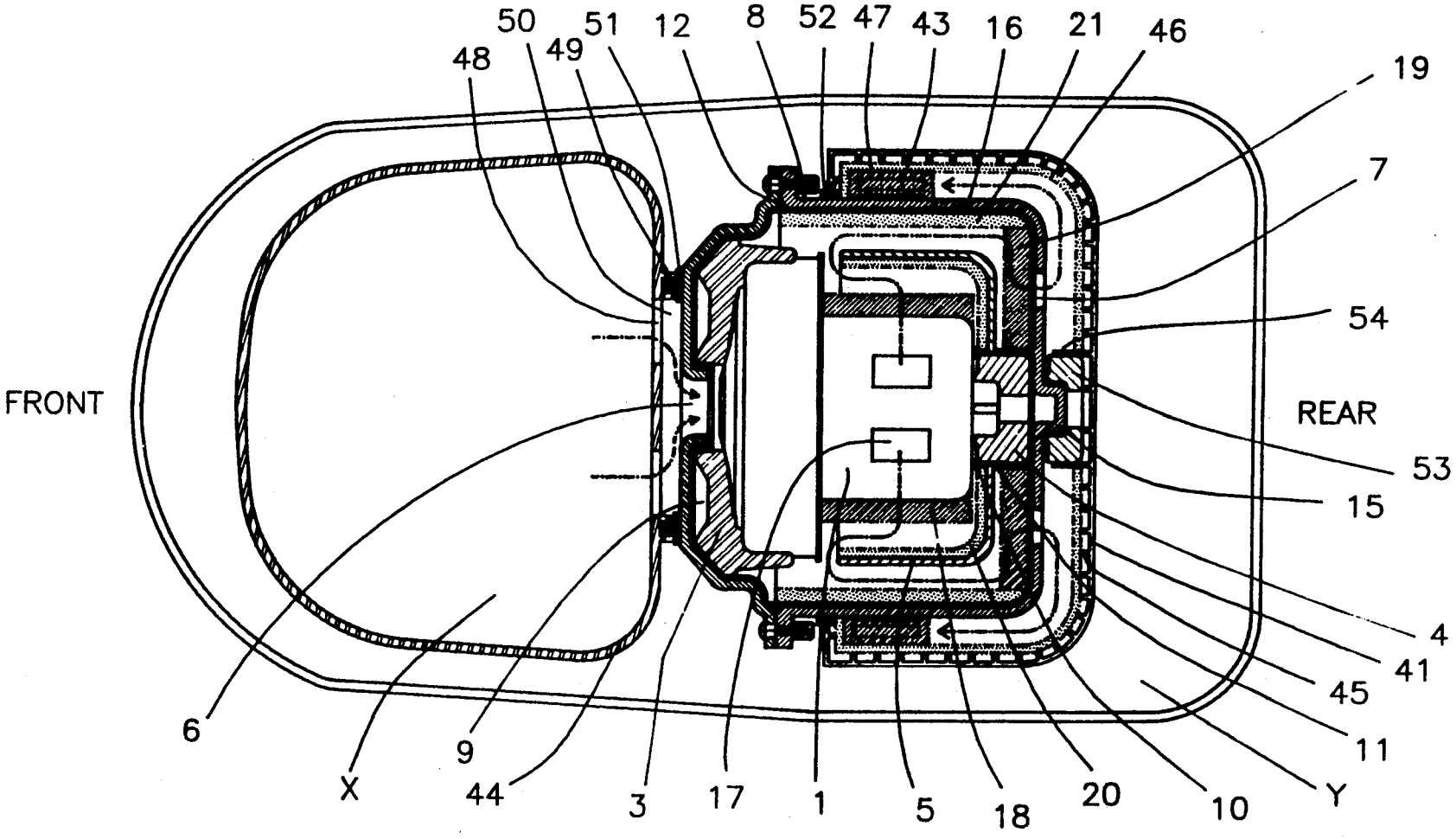
FIG. 5 is a plan sectional view of the vacuum cleaner according to the present invention.

The front blower shock absorbing member 3, as a component of the vibration absorbing means in the blower assembly B, is constituted such that its frontal face is closely contacted with a part of the inner face of the frontal wall of blower case 8, and that a noise absorbing space 9 in the form of an air layer is formed between the member 3 and the inner face of the frontal wall of the blower case 8, as shown in FIGS. 4 and 5.

The cylindrical intermediate case 5 as a component of the noise shielding means is provided with an opening at the center of the rear wall thereof so that rear blower shock absorbing member 4 can be inserted into the opening. Further, case 5 is firmly supported upon the rear blower shock absorbing member 4 by means of two rings 10, 11 which are made of an elastic material and which are installed respectively on the inner and outer faces of the rear wall.

The blower case 8, as another component of the noise shielding means has a cylindrical shape approximately, and consists of frontal and rear cases. The frontal and rear cases are coupled by means of bolts, and a seal ring 12 is inserted between the two cases in order to form an air-tight state and to prevent propagation of noises.

Figure 6:
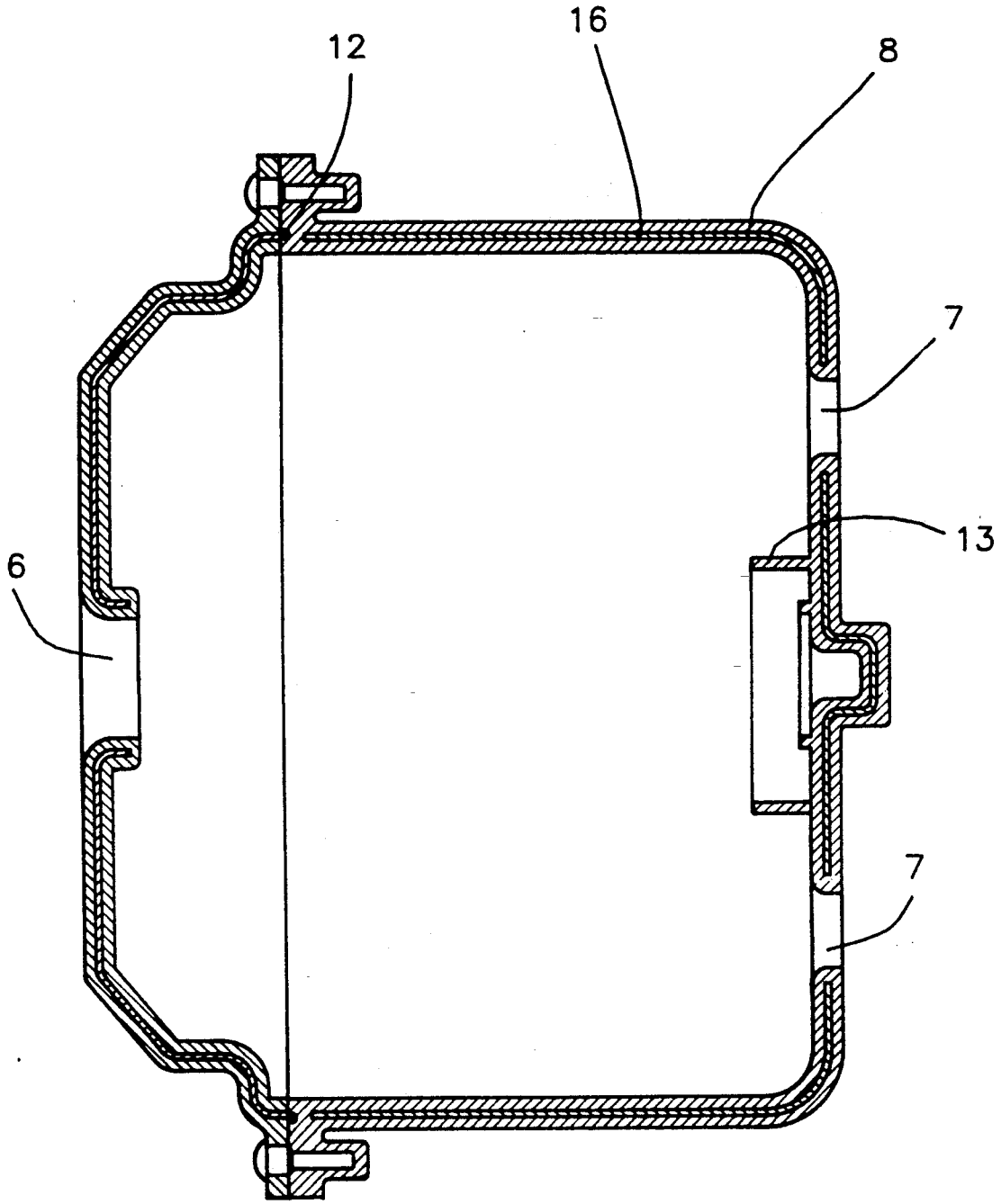
FIG. 6 is a sectional view of an embodiment of the blower case installed in the vacuum cleaner according to the present invention.

The edges of the entrances of both suction hole 6 and outlet hole 7 of blower case 8 are rounded as shown in FIG. 6 in order to ease the flow of air which passes through the holes.

The frontal wall of blower case 8 is shaped such that it should be fit to receive front blower shock absorbing member 3. At the center of the inner face of the rear wall of the blower case 8, there is integrally provided a shock absorbing member receiving section 13 for receiving blower rear shock absorbing member 4, while, at the center of the outer face of it, there is integrally provided a projected portion 15 for being coupled with rear blower assembly shock absorbing member 53.

The blower case 8 is made of a plastic material, and it is desirable to attach a steel sheet 16 on the inside of it in order to reinforce the noise shielding effect. Further, as shown in FIG. 6, the steel sheet 16 can also be inserted into the blower case 8 during the injection molding of it.

The blower assembly B is also provided with the flow path changing means for curving and extending the flow path through which filtered air is discharged from the discharge hole 17 of the electric blower 1 to the outside. Specifically, the assembly B is constituted such that the flow path is primarily bent in a L shape, further bent in a U shape, and still further bent in a S shape, so as for the air to flow in a curved form. In order to make the flow path in the blower assembly B bent primarily in a L shape, and secondarily in a U shape. The frontal end of intermediate case 5 is extended forward relative to the position of the discharge hole 17 of the electric blower 1. Further, in order to make the flow path in the blower assembly B bent tertiarily in a S shape, the outer diameter of the intermediate case 5 is provided in a size larger than the diameter of the circle which passes through the center points of outlet holes 7 being formed in an annular form on the rear wall of blower case 8.

In order to increase the noise damping effect, and in order to reduce the flow resistance of the curved flow path, the blower assembly B is further constituted such that: the flow cross sectional area of the flow path at the U shaped bent portion is larger than the flow cross sectional area at the discharge holes 17 of the electric blower 1; and the flow cross sectional area at the outlet holes 7 of the blower case 8 for discharging the air from the blower case 8 is larger than the flow cross sectional area of the U shaped bent portion.

The blower assembly B as a noise absorbing means for suppressing the noise by absorbing it, which is propagated through the discharge flow path, is further constituted such that: filters 18,19 are attached around the motor section of the electric blower 1 and the inner face of the rear wall of the blower case 8 respectively; and noise absorbing members 20,21 are attached on the inner face of the intermediate case 5 and on the inner surface of the cylindrical wall of the blower case 8 respectively.

The filters 18,19 are capable of absorbing the noise, but do not cause an increase of resistance to the flow of the air. Desirably the filters 18,19 should be made of a material which is fit to absorb the noise having the intermediate frequency of about 1600 Hz. As a material for filters 18,19, foamed urethane has the required properties.

Desirably the noise absorbing members 20,21 should be made of a material which is fit to absorb a high frequency noise of about 4000 Hz. As the material for members 20,21, felt has the required properties.

Blower assembly B is provided with the vibration absorbing means, the noise shielding means, the flow path changing means, and the noise absorbing means as described above. Next, the present invention including, blower assembly B will now be described as to its structure.

Figure 9:
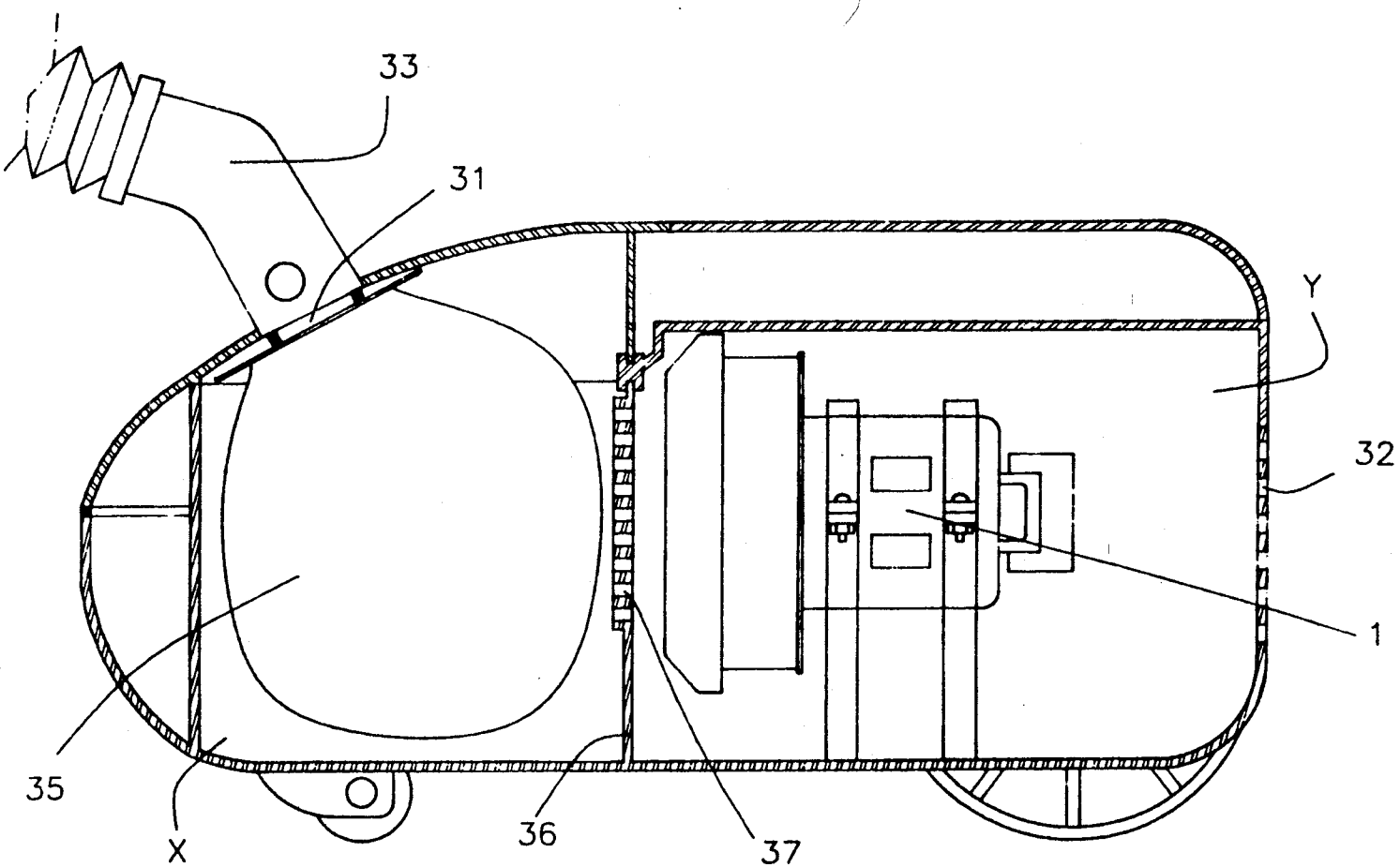
PRIOR ART FIG. 9
FIG. 9 is a side sectional view of a conventional vacuum cleaner.

Generally, as shown in FIG. 9, vacuum cleaners are constituted such that: a dust collecting room X and a blower receiving room Y are separately installed within the main body; an air suction portion 31 is provided on the top of the dust collecting room X; and an outlet section 32 is formed on the blower receiving room Y.

A paper filter 35 is installed within the dust collecting room X in order to keep the dusts after filtering them from the air which is sucked through a suction tube 33, while an electric blower 1 is installed within the blower receiving room Y.

On partition wall 36 which separates dust collecting room X and blower receiving room Y, there are formed a plurality of air suction holes 37, so that air should be able to flow between the dust collecting room X and the blower receiving room Y.

As can be seen in FIG. 4, the vacuum cleaner is constituted such that blower receiving room Y includes a blower assembly receiving section 41 which consists of an upper receiving section 41-1 and a lower receiving section 41-2.

The upper receiving section 41-1 is formed integrally with an upper main body assembly A of the vacuum cleaner, while the lower receiving section 41-2 is formed integrally with a lower main body assembly C. An elastic gasket 42 is provided on the contact portion between the upper and lower receiving sections 41-1,41-2 in order to keep air tight state between them. A circular opening is formed on the frontal wall of blower assembly receiving section 41 in order to install blower assembly B. An outlet section 43 is formed in front of the bottom of the blower assembly receiving section 41 in order to finally discharge air.

As shown in FIG. 4, the distance I between the frontal and rear walls of blower assembly receiving section 41 is determined in such a manner that the frontal wall should be disposed at a position corresponding to the leading end of the motor section of electric blower 1. However, this distance I can be determined such that the frontal wall should be disposed near the rear wall of partition wall 44.

At the center portion of the inner face of the rear wall of blower assembly receiving section 41, a shock absorbing member receiving section 54 is provided integrally with it in order to install a shock absorbing member 53 and support the rear face of blower case 8.

As shown in FIG. 5, a plurality of elongate ribs 45 are formed in the longitudinal direction at certain uniform intervals on the inner face of the longitudinal wall of blower assembly receiving section 41, with the elongate ribs 45 being a means for shielding the noise.

The whole inner surface of blower assembly receiving section 41 excluding outlet section 43, noise absorbing member 46, made of felt, is attached so as for the noise to be absorbed.

On the inner face of the outlet section 43 also, there is installed a filter 47 as a noise absorbing means which is made of foamed urethane, and which is capable of filtering dust and absorbing noise without giving much harmful effect to the resistance of the flow.

The noise absorbing member 46 is made of a material capable of absorbing high frequency noise of about 4000 Hz, while the filter 47 is made of a material capable of absorbing the medium frequency noise of about 1600 Hz.

The outletting cross sectional area of outlet section 43, which is formed on the bottom of blower assembly receiving section 41, is designed to be larger than the cross sectional area of the flow path at outlet holes 7, which is formed on the rear wall of blower case 8 of the blower assembly, in order to decrease the flow resistance of the air and in order to increase the noise dampening effect.

A separating wall 44 is installed within the main body of the vacuum cleaner in order to separate dust collecting room X and blower receiving room Y from each other as described above, and, on the rear wall of partition wall 44, there are formed a plurality of air suction holes 48, so that air should be supplied through paper filter 35 to the electric blower 1 after being sucked through section tube 33.

Figure 7:
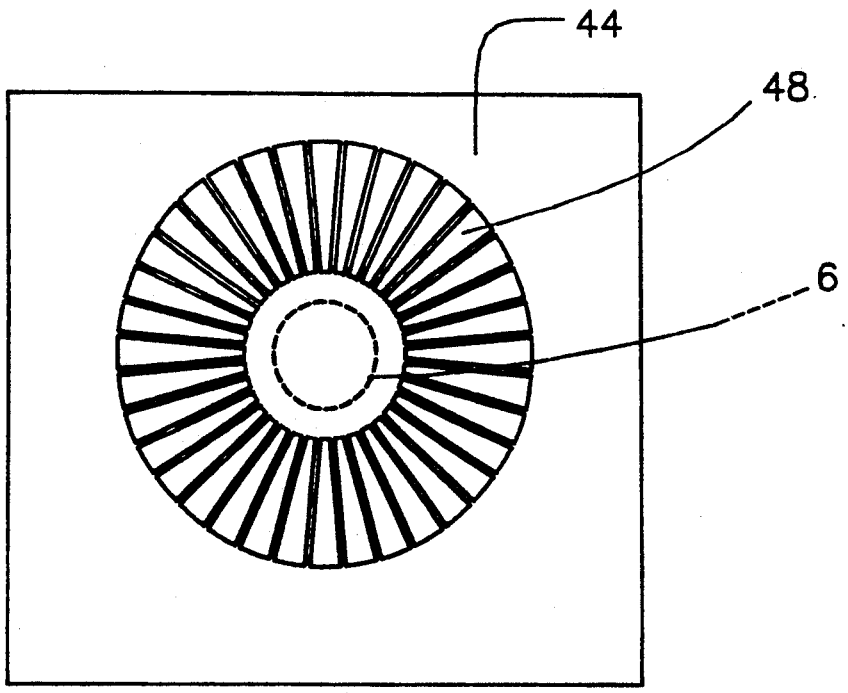
FIG. 7 is a frontal view of the rear portion of the partition wall, with an air suction hole being formed thereon, according to the present invention.

As shown in FIG. 7, air suction holes 48 are disposed in a radiative form at the portion which radially deviates from the center portion which corresponds to suction hole 6 of blower case 8.

The rear wall of partition wall 44 and the frontal wall of blower case 8 are separated from each other by a certain distance by providing ring shaped projection 49 so that cylindrical space 50 can be formed, and therefore, the air which passes through air suction holes 48 flows through the S shaped path to air suction hole 6 of the blower case 8 without being encountered with a high resistance.

The vacuum cleaner of the present invention is provided with a vibration absorbing means on the portion where blower assembly B is contacted with the main body of the vacuum cleaner.

As a component of the vibration absorbing means, there is front blower case shock absorbing member 51 which is inserted between the frontal wall of blower case 8 and ring shaped projection 49 which is formed integrally with partition wall 44. The member 51 not only absorbs the vibrations but also keeps an air-tight state.

As another component of the vibration absorbing means, there is a blower assembly medium shock absorbing member 52 which is inserted between the frontal wall of blower assembly receiving section 41 and a side face of the blower assembly.

As still another component of the vibration absorbing means, there is a rear blower assembly shock absorbing member 53 which is installed between the rear face of blower assembly B and shock absorbing member receiving section 54 of blower assembly receiving section 41.

Figure 3:
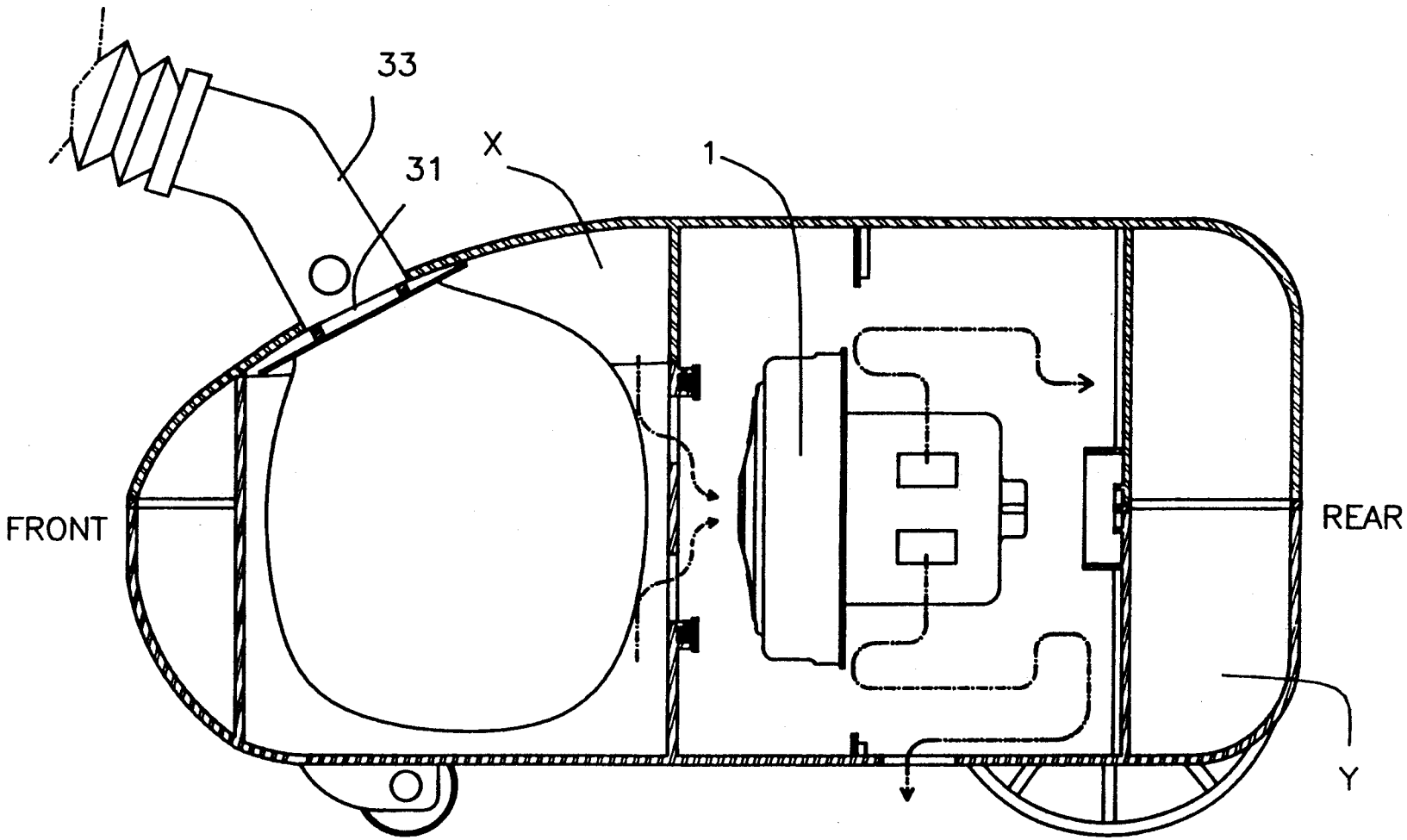
FIG. 3 illustrates the flow path of the vacuum cleaner according to the present invention.
Figure 8:
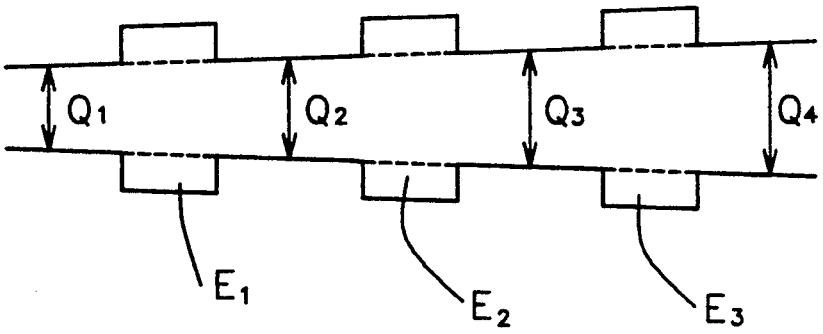
FIG. 8 is a schematic view showing, in a straight line, the flow path of the vacuum cleaner according to the present invention.

In the vacuum cleaner of the present invention, the air flow path between discharge hole 17 of electric blower 1 and outlet section 43 of blower assembly receiving section 41 is formed as shown by the dotted lines in FIG. 3, and this is illustrated schematically in FIG. 8 in a straight line.

As shown in FIG. 8, the flow cross sectional area Q2 at the portion, where the air flow is bent in a U shape, is larger than the flow cross sectional area Q1 of discharge holes 17 of the electric blower 1. Further, flow cross sectional area Q3 of outlet holes 7 of blower case 8, through which the air is discharged from the blower case 8 after curvedly passing through the S shaped bent portion of flow path, is larger than flow cross section area Q2 of the U shaped bent portion. Further, flow across sectional area Q4 of outlet section 43 which is formed on the bottom of blower assembly receiving section 41 is larger than flow cross sectional area Q3 of outlet holes 7 of the blower case 8.

Further, the space between discharge hole 17 of electric blower 1 and the U shaped bent portion of the flow path, i.e., the space between the outer surface of the motor section of electric blower 1 and the inner surface of cylindrical intermediate case 5, forms an expansion chamber E1.

The space between outlet holes 7 of blower case 8 and the U shaped bent portion of the flow path, i.e., the space between the outer face of cylindrical intermediate case 5 and the inner face of the blower case 8, forms also an expansion chamber E2.

Further, the space between outlet holes 7 of blower case 8 and outlet section 43 formed on the bottom of blower assembly receiving section 41, i.e., the space between the outer surface of the blower case 8 and the inner face of blower assembly receiving section 41, forms an expansion chamber E3.

It is well known that expansion chambers can dampen the noise which is propagated through an air flow path, and therefore, they will not be described in detail here. An example of using expansion chambers if the muffler of the exhaustion gas discharge system of automobiles.

In the vacuum cleaner of the present invention, the air flows through wider and wider cross sectional areas of the flow path, as the gas flows downstream. Further, there are installed three expansion chambers in the flow path, and therefore, when the air flows through the flow path, it is not only not subjected to a high resistance, but the noise which is transmitted with the air is also dampened.

The low noise vacuum cleaner constituted as above will now be described as to its operations.

When electric blower 1 is driven, the greater part of the dust and other dirty materials which are introduced through suction tube 33 mixed in the air are filtered by paper filter 35 which is installed within dust collecting room X. The air which is thus cleaned by being filtered is supplied through suction holes 48 of partition wall 44 and through the S shaped bent flow path into the electric blower 1.

The filtered air which is discharged through discharge hole 17 of electric blower 1 flows through an L shaped flow path toward the front of the vacuum cleaner after passing through filter 18 which surrounds the motor section of the electric blower 1. Upon coming out of the front end of cylindrical intermediate case 5, the flow of the air is bent in a U shaped form, and then, flows through between the outer surface of the intermediate case 5 and the inner surface of blower case 8. Then the air flows through an S shaped flow path, to depart from blower assembly B through outlet holes 7, after passing through filter 19 which is attached on the rear wall of the blower case 8.

The air which has come out of blower case 8 turns its flow direction in an L shaped form from the axis of the vacuum cleaner to the radially outer directions, and then, the air flows through between the inner face of blower assembly receiving section 41 and the outer face of rear wall of the blower case 8. Then the flow of the air is bent again in an L shaped form toward the front of the vacuum cleaner. The flow of the air is bent finally in an L shaped form at the portion of outlet section 43 which is provided below the frontal portion of blower assembly receiving section 41, to be discharged through filter 47 and outlet section 43 to the outside of the vacuum cleaner.

The noise generated by electric blower 1 is shielded and absorbed many times by components such as: filter 18 surrounding the motor section of the electric blower 1, intermediate case 5 and noise absorbing member 20 attached on the inside thereof, blower case 8 and noise absorbing member 21 or filter 19 attached on the inside thereof, blower assembly receiving section 41 and noise absorbing member 46 or filter 47 attached on the inside thereof, and the main body of the vacuum cleaner. Therefore, noise scarcely reaches the outside of the vacuum cleaner.

Particularly, a plurality of elongate ribs 45 are formed on the inner face of the longitudinal wall of blower assembly receiving section 41, and therefore, when the noise is collided with the inner face of blower assembly receiving section 41 or reflected therefrom, the greater part of the noise is suppressed by being shielded by the ribs 45.

Further, the flow path is bent many times, and the noise absorbing members and filters are provided through the flow path. Further, the flow path becomes wider and wider as it goes downstream, and a number of spaces in the form of expansion chambers are provided. Therefore, the noise which is propagated through the air flow path is mostly suppressed, so that it should not be able to reach the outside of the vacuum cleaner.

Meanwhile, the noise which is propagated through suction hole 6 of blower case 8, against the flow of air is mostly shielded by partition wall 44. Because, air suction holes 48 are not formed on the rear wall of separating wall 44, which corresponds to air suction hole 6 of blower case 8.

As described above, the noise which is generated by electric blower 1 is mostly shielded or absorbed, thereby greatly reducing the noise propagated to the outside.

Further, in the low noise vacuum cleaner of the present invention, in order to prevent the generation of the noise by the vibrations, front blower shock absorbing member 3 and rear blower shock absorbing member 4 are inserted into between electric blower 1 and blower case 8, so that electric blower 1 and blower case 8 should not be contacted directly to each other.

Further, intermediate case 5 is supported by two elastic rings 10,11 and upon rear blower shock absorbing member 4 which is placed on the back of electric blower 1, and therefore, vibration noises are not generated between intermediate case 5 and electric blower 1, and between intermediate case 5 and blower case 8.

Meanwhile, in installing blower assembly B into blower assembly receiving section 41, blower assembly rear shock absorbing member 53 is installed between the projected portion 15 (which is formed at the center of the outer face of the rear wall of blower case 8) and shock absorbing member receiving section 54 (which is formed at the center of the inner face of the rear wall of blower assembly receiving section 41).

Further, blower assembly medium shock absorbing member 52 is installed between the outer circumferential surface of the cylindrical wall of blower case 8 and the frontal wall of blower assembly receiving section 41, and therefore, blower case 8 does not directly contact with blower assembly receiving section 41. Further, between the frontal wall of blower case 8 and ring shaped projection 49 of partition wall 44, there is also installed a blower assembly frontal shock absorbing member 51, so that blower case 8 and ring shaped projection 49 should not directly contact each other.

Therefore, even if vibrations occur during the operation of electric blower 1, the vibrations are absorbed by the shock absorbing members such as blower frontal shock absorbing member 3, blower rear shock absorbing member 4, blower assembly frontal shock absorbing member 51, blower assembly medium shock absorbing member 52 and blower assembly rear shock absorbing member 53, with the result that no vibration noises are generated.

In order to compare the noise from the vacuum cleaner of the present invention and the noise from the conventional vacuum cleaner of FIG. 9, measurements were carried out at three different positions and under the same conditions, and the results of the measurements are shown in a table below. Further, the measured data are illustrated in FIGS. 10 to 12 in the form of bar graphs.

Figure 10B:
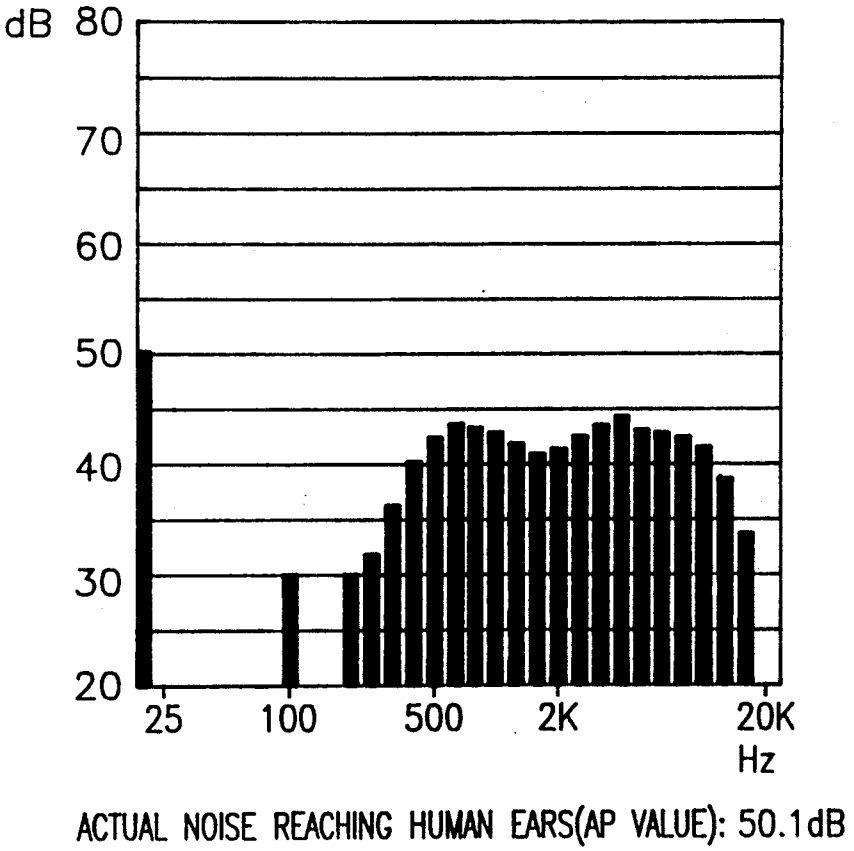
FIG. 10*b* is a graphic illustration showing the magnitude of the noise as measured at the rear of the vacuum cleaner according to the present invention, and based on the frequency of the motor.
Figure 10A:
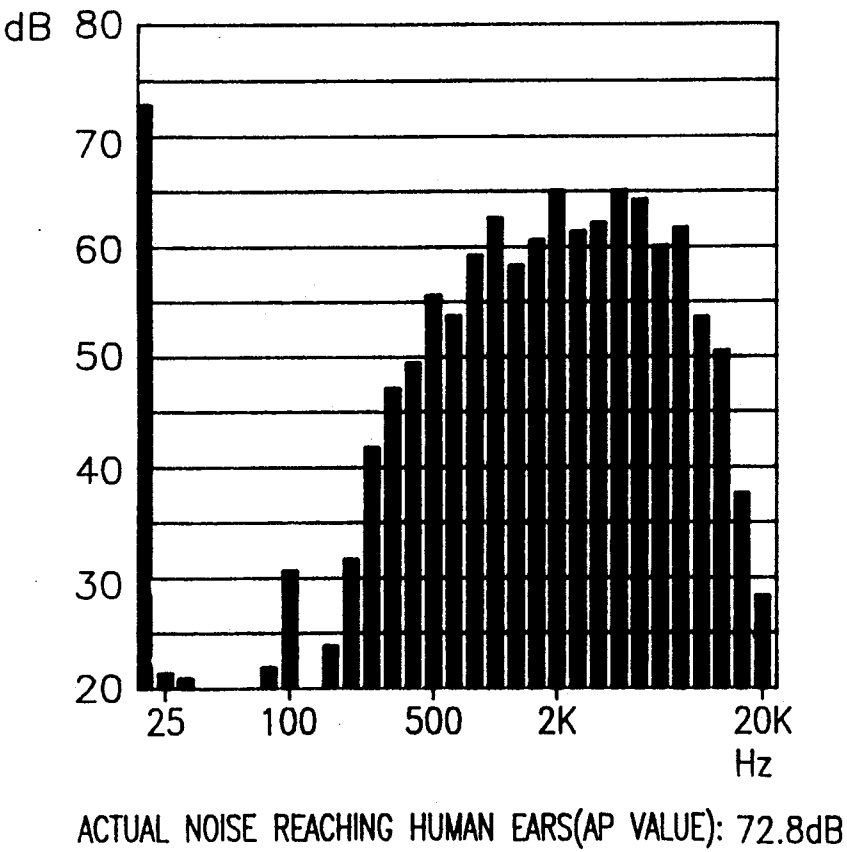
PRIOR ART FIG. 10a
FIG. 10*a* is a graphical illustration showing the magnitude of noise as measured at the rear of a conventional vacuum cleaner, and based on the frequency of the motor.
Figure 11B:
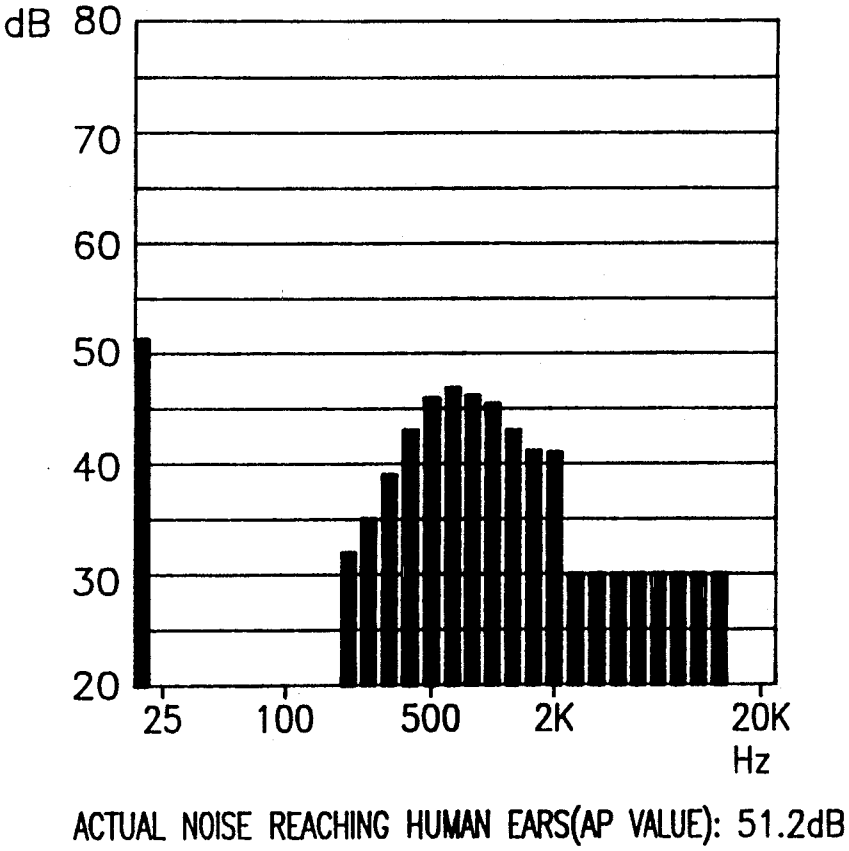
FIG. 11*b* is a graphic illustration showing the magnitude of the noise as measured at the top of the vacuum cleaner according to the present invention and based on the frequency of the motor.
Figure 11A:
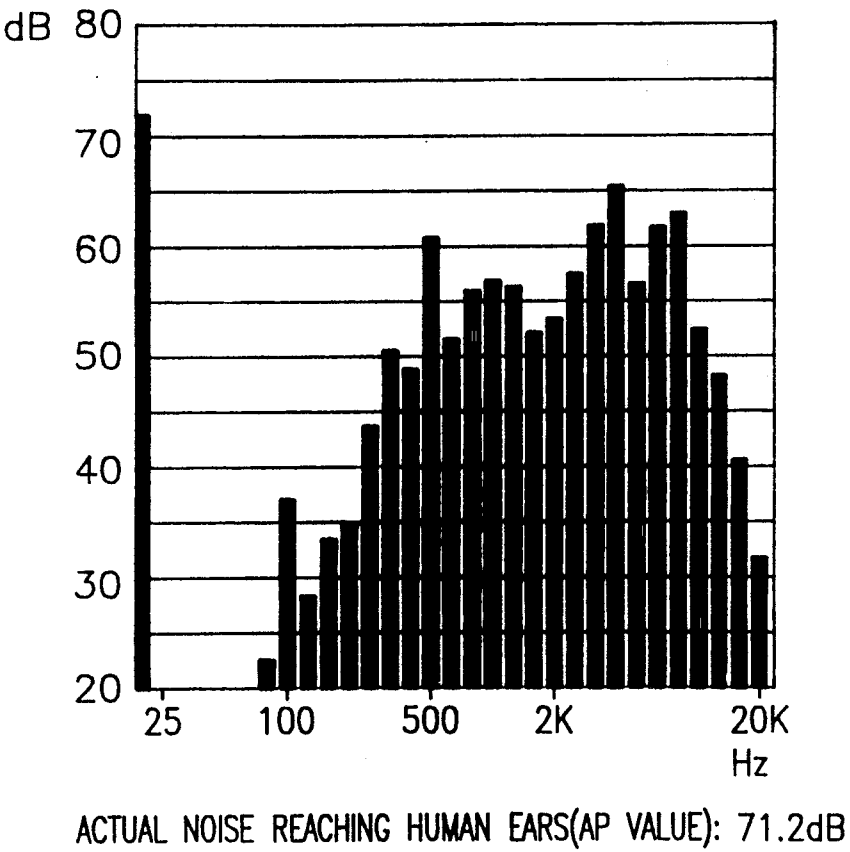
PRIOR ART FIG. 11a
FIG. 11*a* is a graphic illustration showing the magnitude of the noise as measured at the top of the conventional vacuum cleaner and based on the frequency of the motor.
Figure 12B:
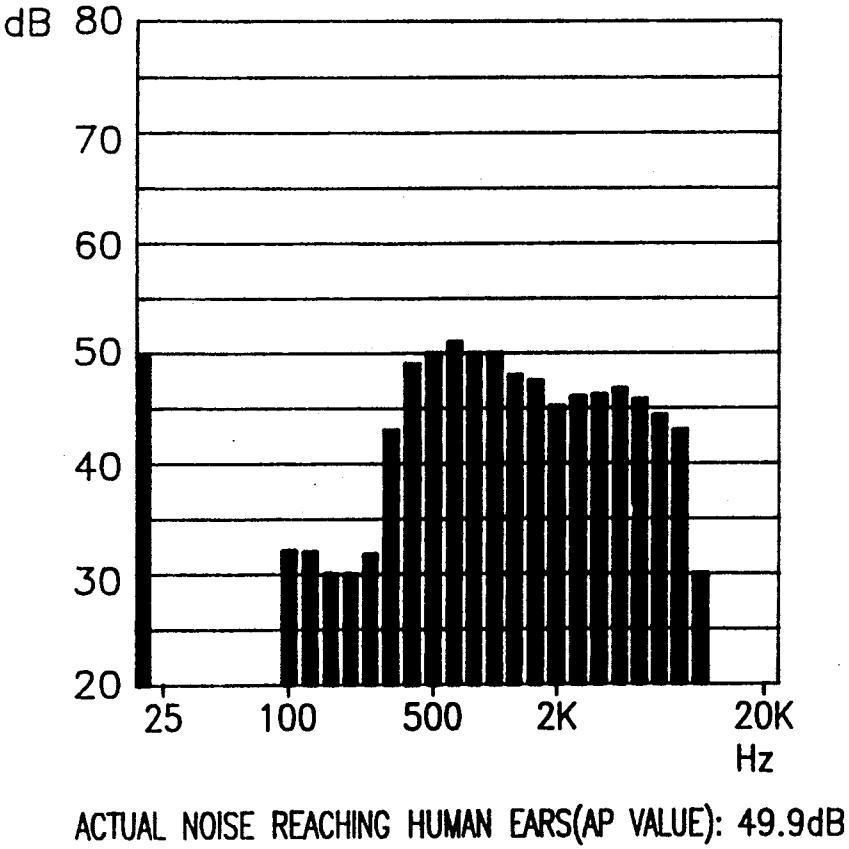
FIG. 12*b* is a graphic illustration showing the magnitude of the noise as measured at a side of the vacuum cleaner according to the present invention and based on the frequency of the motor.
Figure 12A:
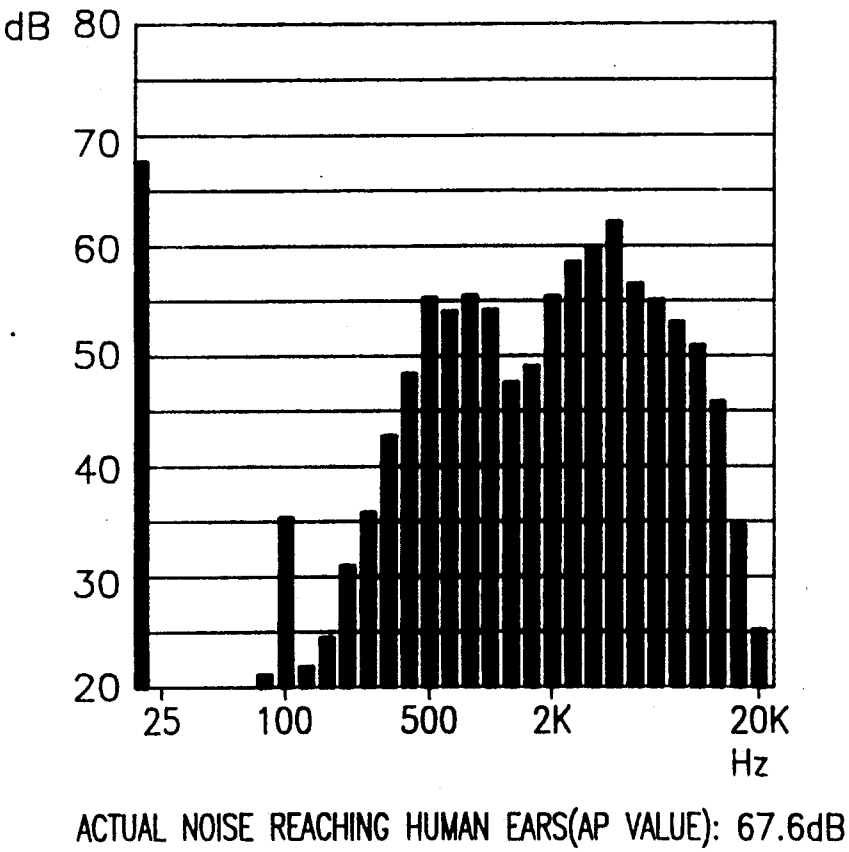
PRIOR ART FIG. 12a
FIG. 12*a* is a graphic illustration showing the magnitude of the noise as measured at a side of the conventional vacuum cleaner and based on the frequency of the motor.

FIG. 10*a* illustrates the magnitudes of the noise measured at the rear of the conventional vacuum cleaner, and FIG. 10*b* illustrates the magnitudes of the noise measured at the rear of the vacuum cleaner of the present invention, both in the form of bar graphs based on the frequencies of the motors. FIG. 11*a* illustrates the magnitudes of the noise measured at the top of the conventional vacuum cleaner, and FIG. 11*b* illustrates the magnitudes of the noise measured at the top of the vacuum cleaner of the present invention, both in the form of bar graphs based on the frequencies of the motors. FIG. 12*a* illustrates the magnitudes of the noise measured at aside of the conventional vacuum cleaner, and FIG. 12*b* illustrates the magnitudes of the noise measured at a side of the vacuum cleaner of the present invention, both in the form of bar graphs based on the frequencies of the motors.

As can be seen in FIGS. 10 to 12, the present invention achieves a reduction of actual noise reaching human ears (AP value) by about 17.7–22.7 dB compared with the conventional vacuum cleaner.

Generally, a noise reduction of 3 dB makes the human ears feel as if a noise reduction to one half is effected, and therefore, the noise reduction of the present invention is equivalent to a feeling noise reduction of 1/60 to 1/190.

According to the present invention as described above, noise can be greatly inhibited, and therefore, vacuum cleaning can be performed under a pleasantly calm atmosphere.

Further, in the vacuum cleaner of the present invention, outlet section 43, which finally discharges the air to the outside, is installed on the bottom of the vacuum cleaner. The bacteria existing on the floor can be killed by the heat of the air. Further, the noise which is leaked after being shielded and absorbed is not directly transferred to humans but is scattered by the floor, so that noise is further reduced.

The present invention was described based on the preferred embodiment in the above, but it should be apparent to those skilled in the art of vacuum cleaning that the present invention can be modified and changed in various ways within the scope of the spirit and principle of the present invention, and therefore, all such changes and modifications should come within the scope of the attached claims.

TABLE

| Measuring Position | Noise at the rear (dB) | | Noise at the top (dB) | | Noise at the side (dB) | |
|---|---|---|---|---|---|---|
| kind Frequency (Hz) | Conventional | Present Invention | Conventional | Present Invention | Conventional | Present Invention |
| 25 | 20.7 | 20.0 | 20.0 | 20.0 | 20.0 | 20.0 |
| 31.5 | 20.6 | 20.0 | 20.0 | 20.0 | 20.0 | 20.0 |
| 40 | 20.0 | 20.0 | 20.0 | 20.0 | 20.0 | 20.0 |
| 50 | 20.0 | 20.0 | 20.0 | 20.0 | 20.0 | 20.0 |
| 63 | 20.0 | 20.0 | 20.0 | 20.0 | 20.0 | 20.0 |
| 80 | 21.9 | 20.0 | 22.5 | 20.0 | 21.1 | 20.0 |
| 100 | 30.6 | 30.0 | 36.9 | 20.0 | 35.4 | 32.1 |
| 125 | 20.0 | 20.0 | 28.2 | 20.0 | 21.9 | 32.0 |
| 160 | 24.0 | 20.0 | 34.3 | 20.0 | 24.5 | 30.0 |
| 200 | 31.3 | 30.0 | 34.9 | 31.8 | 30.9 | 30.0 |
| 250 | 41.8 | 31.8 | 43.8 | 35.0 | 35.8 | 31.8 |
| 315 | 46.9 | 36.0 | 50.5 | 39.0 | 42.6 | 38.0 |
| 400 | 49.6 | 40.2 | 48.8 | 43.0 | 48.3 | 44.0 |
| 500 | 55.2 | 42.5 | 60.9 | 45.9 | 55.2 | 45.0 |
| 630 | 53.9 | 43.9 | 51.7 | 46.8 | 54.0 | 46.0 |
| 800 | 59.4 | 43.2 | 55.9 | 46.1 | 55.4 | 45.0 |
| 1K | 61.7 | 43.0 | 56.8 | 45.4 | 54.1 | 45.0 |
| 1.25K | 58.7 | 42.0 | 56.1 | 43.0 | 47.6 | 43.0 |
| 1.6K | 60.4 | 41.2 | 52.3 | 41.1 | 49.0 | 42.5 |
| 2K | 65.0 | 41.3 | 53.3 | 41.0 | 55.4 | 40.2 |
| 2.5K | 61.0 | 43.0 | 57.5 | 30.0 | 58.4 | 41.0 |
| 3.15K | 62.0 | 43.3 | 62.8 | 30.0 | 59.9 | 41.2 |
| 4K | 65.1 | 44.0 | 65.2 | 30.0 | 62.1 | 41.8 |
| 5K | 64.4 | 43.5 | 56.4 | 30.0 | 56.4 | 40.8 |
| 6.3K | 60.0 | 43.1 | 61.3 | 30.0 | 55.1 | 39.3 |
| 8K | 61.1 | 42.9 | 63.0 | 30.0 | 53.1 | 38.0 |
| 10K | 53.6 | 41.4 | 52.5 | 30.0 | 50.9 | 30.0 |
| 12.5K | 50.1 | 38.3 | 48.2 | 30.0 | 45.9 | 20.0 |
| 16K | 37.5 | 33.3 | 40.3 | 20.0 | 34.7 | 20.0 |
| 20K | 28.0 | 20.0 | 31.1 | 20.0 | 25.1 | 20.0 |
| Actual Noise reaching human ear (AP value) | 72.8 | 50.1 | 71.2 | 51.2 | 67.6 | 49.9 |

What is claimed is:

1. A vacuum cleaner including an air suction portion disposed on a wall of a first portion of the vacuum cleaner, a dust collecting room disposed in the first portion of the vacuum cleaner, a blower receiving room disposed in a second portion of the vacuum cleaner, and an air outlet portion disposed on a bottom side at the second portion of the vacuum cleaner, in addition to a blower assembly, said vacuum cleaner comprising:

a partition wall for separating said dust collecting room and said blower receiving room from each other, and provided with a plurality of air suction holes in a radiative form, the air suction holes radially deviating from a center portion which corresponds to a suction hole of the blower assembly;

a blower assembly receiving section for supporting said blower assembly, and for absorbing and shielding noise passed through the blower assembly, the blower assembly receiving section being disposed at a first end of the blower receiving room away from the partition wall; and vibration absorbing means disposed on a contact portion between said blower assembly and said blower assembly receiving section.

2. A vacuum cleaner as claimed in claim 1, wherein said blower assembly is surrounded by a blower case which is disposed in the blower receiving room, the blower case having a suction hole being formed at a center of a first surface thereof, and a plurality of outlet holes being formed in an annular form on a second surface thereof opposite to the first surface; and said blower assembly further comprises:

vibration absorbing means for absorbing vibrations generated by said blower assembly, said vibration absorbing means being disposed at a first and second ends of the blower assembly;

noise shielding means for shielding noise generated by said blower assembly, the noise shielding means including a blower case and an intermediate case which are telescopically disposed between each other, the blower assembly being disposed in the intermediate case and the blower case;

flow path changing means disposed between the noise shielding means for curving and extending a flow path of air passing through said blower assembly; and noise absorbing means for suppressing the noise by absorbing the noise transferring with the air flowing through said flow path of air, said noise absorbing means being disposed on an inside surface of both the intermediate case and the blower case.

3. A vacuum cleaner as claimed in claim 2, wherein a first cross sectional area of an outlet section formed on a bottom side of said blower assembly receiving section is larger than a second cross sectional area of outlet holes formed on the the second surface of said blower case.

4. A vacuum cleaner as claimed in claim 1, wherein said blower assembly receiving section comprises:

a first receiving section formed integrally with a first main body assembly; and second receiving section formed integrally with a second main body assembly, having a shock absorbing member receiving section being formed at a center of an inner surface of a first surface thereof, having a second surface thereof being open where said blower assembly is disposed, and having an outlet section being formed on a bottom side of the second main body assembly.

5. A vacuum cleaner as claimed in claim 4, wherein a first cross-sectional area of an outlet section formed on a bottom side of the blower assembly receiving section is larger than a second cross-sectional area of the outlet holes formed on the second surface of the blower case.

6. A vacuum cleaner as claimed in claim 1, wherein said blower assembly receiving section is provided with a plurality of elongated ribs in a longitudinal direction at a uniform intervals on an inside surface of a longitudinal wall of the blower assembly receiving section proximate to the first end of the blower receiving room, said blower assembly receiving section being further provided with a filter attached on an inside surface of an outlet section of the blower assembly receiving section proximate to the first end of the blower receiving room, and said blower assembly receiving section being further provided with a noise absorbing member covered on an inside surface thereof excluding the inside surface of said outlet section.

7. A vacuum cleaner as claimed in claim 1, wherein said partition wall is provided with a ring shaped projection on a second surface thereof so that the patition wall is separated from a first surface of said blower case of said blower assembly, and so that a cylindrical space is formed between said partition wall and said blower case.

8. A vacuum cleaner as claimed in claim 1, wherein said vibration absorbing means comprises:

a first blower assembly shock absorbing member disposed between a ring shaped projection on one side of the partition wall proximate to the blower assembly and a first surface of said blower assembly;

a second blower assembly shock absorbing member disposed between a side surface of said blower assembly and a a first surface of said blower assembly receiving section; and a third blower assembly shock absorbing member disposed between a second surface of said blower assembly and a shock absorbing member receiving section of said blower assembly receiving section.

9. A vacuum cleaner including an air suction portion at a first portion of the vacuum cleaner, a dust collecting room connecting to the air suction portion, a blower receiving room connecting to the dust collecting room for receiving an electric blower, and an outlet section for discharging air disposed on one side of the blower receiving room, a flow path extended from said dust collecting room to a suction hole at a first end of said electric blower being bent in an S shaped form, the flow path extended from a discharge hole which is disposed on a surface of said electric blower to outlet holes which are disposed on a surface of a blower case being bent in a L shaped form, a U shaped form and a S shaped form, and the flow path extended from said outlet holes of said blower case to said outlet section being bent at least twice in a L shaped form.

10. A blower assembly of a vacuum cleaner having an electric blower, comprising:

vibration absorbing means for absorbing vibrations generated by the electric blower, said vibration absorbing means being disposed at a first and second ends of the electric blower;

noise shielding means, including a blower case and an intermediate case telescopically disposed between each other in the vacuum cleaner, for shielding noise generated by the electric blower;

flow path changing means disposed between the noise shielding means for curving a plurality of times and extending a flow path of air discharged from said electric blower;

noise absorbing means for suppressing the noise by absorbing the noise transferring with the air flowing through the flow path of air, said noise absorbing means being disposed on an inside surface of the noise shielding means; and wherein the noise absorbing means comprises:

at least one filter being attached around a motor portion of said electric blower, and on an inside surface of a second surface of said blower case respectively; and at least one noise absorbing member attached on an inside surface of said intermediate case and on an inside circumferential surface of a cylindrical wall of said blower case respectively.

11. A blower assembly as claimed in claim 10, wherein said filter is made of a material suitable for absorbing a first frequency noise, and said noise absorbing member is made of a material suitable for absorbing a second frequency noise.

12. A blower assembly of a vacuum cleaner having an electric blower, comprising:

vibration absorbing means for absorbing vibrations generated by the electric blower, said vibration absorbing means being disposed at a first and second ends of the electric blower;

noise shielding means, including a blower case and an intermediate case telescopically disposed between each other in the vacuum cleaner, for shielding noise generated by the electric blower;

flow path changing means disposed between the noise shielding means for curving a plurality of times and extending a flow path of air discharged from said electric blower;

noise absorbing means for suppressing the noise by absorbing the noise transferring with the air flowing through the flow path of air, said noise absorbing means being disposed on an inside surface of the noise shielding means;

wherein said vibration absorbing means includes:

a first blower shock absorbing member, disposed between an inside surface of the blower case and an outside surface of the electric blower at the first end, the first blower shock absorbing member of the electric blower surround the outside surface and a part of a side surface of the electric blower at the first end; and a second blower shock absorbing member disposed at a center of a surface at the second end of the electric blower; and wherein a shock absorbing member receiving section is disposed at a center of an inside surface of a second surface of said blower case in an integral form, a projected portion being formed at a center of an outside surface of the second surface of said blower case, and said second blower shock absorbing member being disposed in said shock absorbing member receiving section.

* * * * *